US006938730B2

(12) United States Patent
Hairston

(10) Patent No.: US 6,938,730 B2
(45) Date of Patent: Sep. 6, 2005

(54) BUDDY'S ADJUSTABLE HEIGHT WORKHORSE

(76) Inventor: Nathaniel Hairston, 827 Smith Rd., Martinsville, VA (US) 24112

( * ) Notice: Subject to any disclaimer, the term of this patent is extended or adjusted under 35 U.S.C. 154(b) by 41 days.

(21) Appl. No.: 10/659,348

(22) Filed: Sep. 11, 2003

(65) Prior Publication Data

US 2005/0056488 A1 Mar. 17, 2005

(51) Int. Cl.[7] ..... E04G 3/16
(52) U.S. Cl. ..... 182/17; 182/178.1
(58) Field of Search ..... 182/15, 16, 17, 182/113, 178.1

(56) References Cited

U.S. PATENT DOCUMENTS

| | | | | | |
|---|---|---|---|---|---|
| 902,949 | A | | 11/1908 | Dibler | |
| 1,432,040 | A | | 10/1922 | Schuler | |
| 1,736,501 | A | | 11/1929 | Macklem | |
| 2,072,354 | A | | 3/1937 | Biebel | |
| 2,310,119 | A | * | 2/1943 | Reinhardt | 182/17 |
| 2,573,575 | A | | 10/1951 | Keroson | |
| 2,857,212 | A | | 10/1958 | Everitt | |
| 3,340,959 | A | * | 9/1967 | Wilson | 182/36 |
| 3,548,970 | A | | 12/1970 | Hutchens, Sr. | |
| 3,552,521 | A | * | 1/1971 | Tate | 182/17 |
| 3,596,735 | A | * | 8/1971 | Denier et al. | 182/16 |
| 3,825,095 | A | | 7/1974 | Clark | |
| 3,851,854 | A | | 12/1974 | Roybal | |
| 4,453,619 | A | | 6/1984 | Bierman | |
| 4,534,447 | A | * | 8/1985 | Champigny | 182/152 |
| 4,565,262 | A | * | 1/1986 | Hawkins | 182/116 |
| 4,598,794 | A | | 7/1986 | Anderson | |
| 4,886,139 | A | | 12/1989 | Dupont et al. | |
| 4,967,733 | A | | 11/1990 | Rousseau | |
| 6,076,621 | A | | 6/2000 | Horn | |
| 6,109,390 | A | | 8/2000 | Giannopoulos | |
| 6,431,314 | B1 | * | 8/2002 | Boulanger et al. | 182/63.1 |
| 6,446,752 | B2 | | 9/2002 | Philippe | |
| 6,732,836 | B2 | * | 5/2004 | Ono | 182/113 |
| 6,745,871 | B2 | * | 6/2004 | Armstrong | 182/222 |
| 2002/0096394 | A1 | | 7/2002 | Chick | |
| 2003/0178253 | A1 | * | 9/2003 | Tatge et al. | 182/132 |

FOREIGN PATENT DOCUMENTS

| | | |
|---|---|---|
| FR | 2 624 173 | 6/1989 |

* cited by examiner

*Primary Examiner*—Alvin Chin-Shue
(74) *Attorney, Agent, or Firm*—Richard C. Litman

(57) ABSTRACT

The adjustable height workhorse is a height adjustable workspace for allowing a worker to easily hang sheet rock on walls at elevated heights. The workhorse provides a platform supported by a frame having a plurality of vertical posts and a plurality of horizontal height adjustment bars. The frame is positioned on a base board. A plurality of wheels is disposed underneath of the base board. The wheels allow the workhorse to be repositioned while the worker is on the platform. The height adjustment bars are mounted on either side of the frame. The bars are positioned at varying heights so that the worker may adjust the height of the platform. The platform is disposed across the frame and is supported by the height adjusting bars. The platform is of suitable size to support a worker and the worker's sheet rock material while providing enough room for the worker to operate.

16 Claims, 8 Drawing Sheets

BUDDY'S ADJUSTABLE HEIGHT WORKHORSE

BACKGROUND OF THE INVENTION

1. Field of the Invention

The present invention relates generally to scaffolds and more particularly to an adjustable height scaffold with a work platform for use in hanging sheetrock.

2. Description of the Related Art

When hanging sheet rock it is often necessary to reach elevated areas of a wall that are out of reach of the worker while standing on the floor. Many different devices are in existence that can aid a worker hang sheet rock at heights greater than that of the worker. Common devices include lifts and scaffold devices for elevating the worker while hanging sheet rock. The following patent documents disclose devices for lifting a worker.

French Patent number 2 624 173 published on Jun. 9, 1989 discloses a climbing platform-scaffolding forming an independent unit. The climbing scaffolding comprises at least one vertical mast that is supported against a vertical wall. The mast serves as an anchor for a cable that allows a platform to slide vertically up and down the cable. The platform also provides handrails to protect the workers that are positioned on the platform.

U.S. Pat. No. 6,446,752 issued on Sep. 10, 2002 to Philippe, M. J., discloses a scaffolding assembly. The invention is a bracing assembly for supporting an upright structure. The scaffolding assembly comprises a horizontal platform that is supported by a pair of vertical supports. A bracing assembly, comprising two angled braces, is secured to the vertical supports to prevent them from collapsing. The scaffolding further provides a guide rail on the platform.

U.S. Pat. No. 6,109,390 issued on Aug. 29, 2000 to Giannopoulos, J. discloses a motorized scaffolding truck. The scaffolding truck provides a horizontal support frame that is adapted for supporting scaffolding and ladders. A vertical steering mast is secured to the horizontal support frame for steering the motorized truck. A plurality of wheels is secured to the bottom of the support frame. A motor, for driving the plurality of wheels, is mounted on the support frame. Once the scaffolding is supported on the truck, the truck allows the scaffolding to be easily repositioned by driving it from one position to the next.

U.S. Pat. No. 6,076,621 issued on Jun. 20, 2000 to Horn, G. H. discloses a mobile work platform. The work platform comprises a base portion housing a motor and gear box for driving the mobile platform. A plurality of wheels is mounted to the underside of the base. A pair of ladders is mounted to, and extends upward from, the top of the base. The ladders support a horizontally disposed work platform that includes a plurality of guard rails disposed around it. The mobile platform also provides a control system for regulating the speed and direction of travel of the platform.

U.S. Pat. No. 4,967,733 issued on Nov. 6, 1990 to Rousseau, Y. J. discloses a lifting carriage. The lifting carriage comprises a base member having a plurality of wheels disposed along its underside. A motor for driving the wheels is mounted to the base. A rectangular frame, having four corner posts, for supporting a horizontal platform is disposed on top of the base. A motor and chain assembly powers the platform to move vertically along the four corner posts.

U.S. Pat. No. 4,886,139 issued on Dec. 12, 1989 to Dupont et al. discloses a mobile scaffold with a power operated platform elevation. The scaffold includes a base mounted on a set of wheels for repositioning of the scaffold. A pair of masts is mounted to the base and supports a horizontal platform. The height of the masts may be increased by the addition of a mast extension. The mast extension is powered by a motor mounted to the base of the scaffold.

U.S. Pat. No. 3,548,970 issued on Dec. 22, 1970 to Hutchens, Sr., R. W. discloses a scaffolding and material handling system. The invention is a vertically extendible scaffolding assembly in which the scaffolding is supported by vertically moveable carriages that are connected to vertical frame members. The material handling portion of the assembly comprises a vertical chain conveyor system for lifting materials from a lower level to an upper level for subsequent movement by a horizontal conveyor at the upper work level.

U.S. Pat. No. 4,598,794 issued on Jul. 8, 1986 to Anderson, C. E., U.S. Pat. No. 4,453,619 issued on Jun. 12, 1984 to Bierman, J. H., U.S. Pat. No. 3,851,854 issued on Dec. 3, 1974 to Roybal, F. V., U.S. Pat. No. 3,825,095 issued on Jul. 23, 1974 to Clark, A. L., U.S. Pat. No. 2,857,212 issued on Oct. 21, 1958 to Everitt, R., U.S. Pat. No. 2,573,575 issued on Oct. 30, 1951 to Keroson, G. E., U.S. Pat. No. 2,072,354 issued on Mar. 2, 1937 to Biebel, J. P., U.S. Pat. No. 1,736,501 issued on Nov. 19, 1929 to Macklem, J. J., U.S. Pat. No. 1,432,040 issued on Oct. 17, 1922 to Schuler, E., U.S. Pat. No. 902,949 issued on Nov. 31, 1908 to Dibler, J. M., and U.S. Patent Application number 2002/0096394 published on Jul. 25, 2002 for Chick, M. C. each disclose general scaffolding assemblies.

Many of the inventions disclosed above provide scaffolds that are secured directly to the wall that the user is working on. These are not advantageous to someone hanging sheet rock because they can not be moved easily and since they are secured to the wall they do not leave room to mount the sheet rock. Other patents disclose free standing lifts with platforms. The platforms discussed above are not advantageous to workers hanging sheet rock because the platforms do not provide sufficient room to support the worker, to support sheet rock materials and for the worker to move freely to hang the sheet rock. A worker using these platforms would have to lower the platform every time more sheet rock material was needed. Therefore, what is needed is a height adjustable workstation that may be easily moved while the worker is positioned on the platform. What is also needed is a height adjustable workstation that provides sufficient room for a worker, sheet rock material, waste material and still leave enough room for the worker to cut and mount the sheet rock material.

None of the above inventions and patents, taken either singly or in combination, is seen to describe the instant invention as claimed. Thus an adjustable height workhorse solving the aforementioned problems is desired.

SUMMARY OF THE INVENTION

The adjustable height workhorse of the present invention is a height adjustable workspace for allowing a worker to easily hang sheet rock on walls at elevated heights. The adjustable height workhorse provides a work platform supported by a frame assembly having a plurality of vertically disposed posts and a plurality of horizontally disposed height adjustment bars. The support frame is positioned on the top surface of a base board. A plurality of wheels is disposed underneath of the base board.

The wheels allow the workhorse to be repositioned along the work area while the worker is located on the platform.

The workhorse may be repositioned manually by the worker or automatically by a motor.

The plurality of height adjustment bars is mounted on either side of the support frame. The bars are positioned at varying heights so that the worker may adjust the height of the platform according to his height and needs. Each of the posts on the frame are equipped with post securing pins that are adapted to secure a second set of posts on top of the support frame. The second set of posts may be added to the support frame to increase the height of the workhorse if needed.

The platform is horizontally disposed across the support frame and is supported by the height adjusting bars. The platform is of suitable size to support a worker and the worker's sheet rock material while providing enough room for the worker to operate. One side of the platform extends sufficiently beyond the support frame to provide a storage space for the worker's waste materials. A plurality of restraint beams is disposed along the top surface of the platform. The restraint beams secure the sheet rock material and waste material in place while they are resting on the platform.

Accordingly, it is a principal object of the invention to provide a height adjustable workstation that may be easily moved while the worker is positioned on the platform.

It is another object of the invention to provide a height adjustable workstation with sufficient room for a worker, sheet rock material, waste material and still leave enough room for the worker to cut and mount the sheet rock material.

It is a further object of the invention to provide a height adjustable workstation that can support a work platform at varying heights to easily accommodate the needs of the user.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
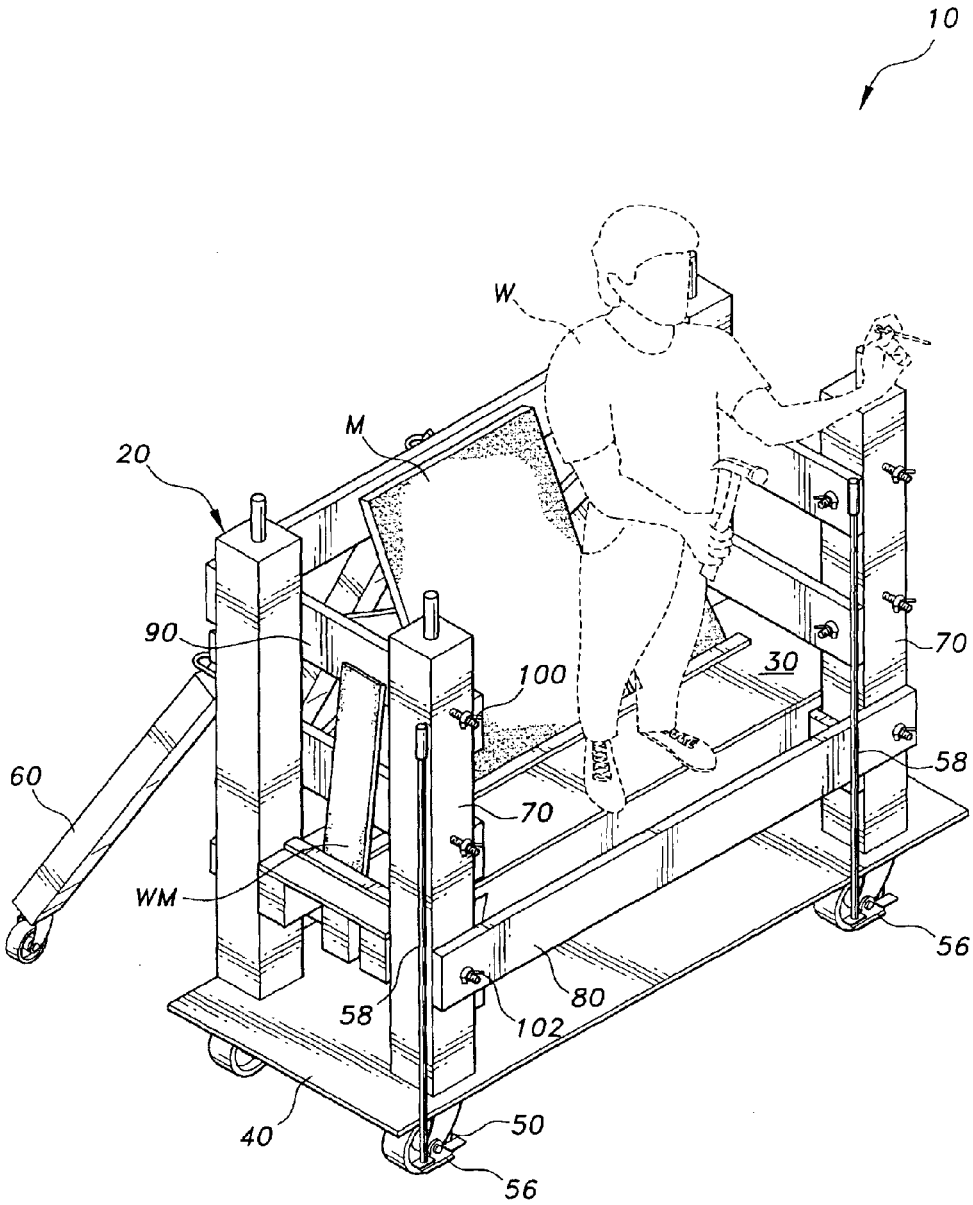
FIG. 1 is an environmental, perspective view of an adjustable height workhorse according to the present invention.

The present invention is a workhorse that provides a workstation whose height may be adjusted to aid workers in installing sheetrock. FIG. 1 is an environmental, perspective view of an adjustable height workhorse 10 according to a preferred embodiment of the present invention. The workhorse comprises a support frame 20, a work platform 30, a base board 40, wheel assemblies 50 and a plurality of braces 60. The platform 30 provides a workspace that supports the worker W and his sheetrock materials M. The platform 30 also provides an area outside of the support frame 20 for storing waste material WM. The base board 40 provides an area underneath of the platform 30 where the worker W may store his tools.

Figure 2:
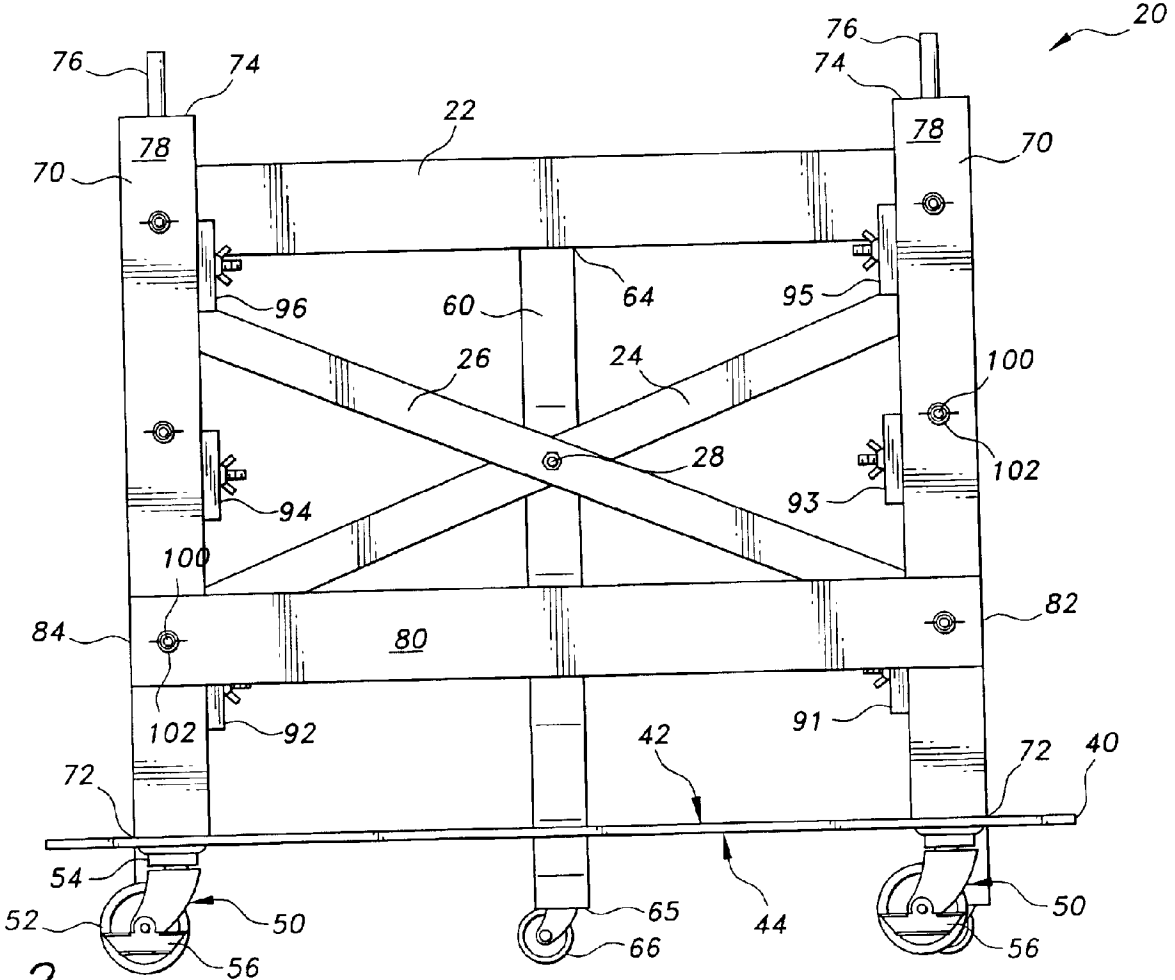
FIG. 2 is a front view of the frame of the adjustable height workhorse.

The support frame 20 comprises a plurality of posts 70, a plurality of height adjusting rails 90 and a plurality of support crossbars. The platform 30 is horizontally disposed across the support frame 20 and is supported on either side of the frame 20 by one of the plurality of height adjusting rails 90. FIG. 2 depicts a front view of the support frame 20 with the platform 30 removed from the workhorse 10. The frame 20 includes a top cross bar 22 and two angled cross bars 24, 26. The top cross bar 22 and the angled crossbars 24, 26 are disposed along the rear of the support frame 20. The cross bars act as protective supports that prevent the worker W or the material M from falling off of the workhorse 10.

According to the preferred embodiment of the workhorse 10 the frame 20 comprises four posts 70. Two posts 70 are disposed on either end of the base board 40. Each of the four posts 70 is disposed on the top surface 42 of the base 40. Each post comprises a top 74, a bottom 72, an exterior surface 78 and a post securing pin 76. The post securing pins 76 are disposed in a hole 77 located in the center of the top 74 of each post 70. The hole 77 allows the securing pins 76 to extend a distance into the post 70.

Figure 4:
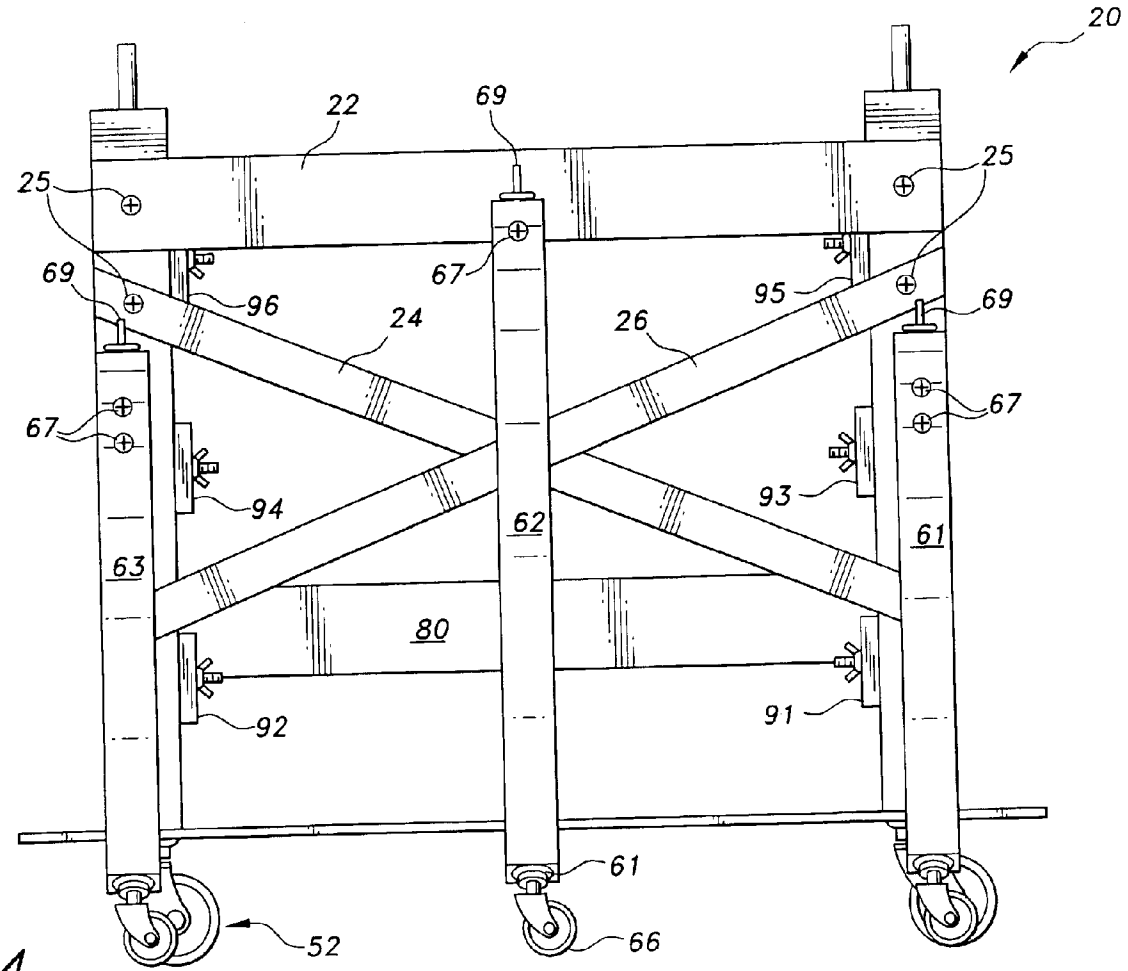
FIG. 4 is a rear view of the frame of the adjustable height workhorse.

As shown in FIG. 4 the top cross bar 22 extends across the rear of the support frame 20 and is secured to the exterior surface 78 of the two rear posts 70. Each of the two angled cross bars 24, 26 extend diagonally across the rear of the frame 20 from the top 74 of one of the posts 70 to the bottom 72 of one of the posts 70. The two angled cross bars 24, 26 are secured to one another at their point of intersection by a fastener 28 (shown in FIG. 2).

The height adjusting rails 90 are disposed on either side of the support frame 20. According to the preferred embodiment of the present invention there are three height adjusting rails 90 positioned on each side of the support frame 20. Each of the rails 90 is mounted across two adjacent posts 70 (as shown in FIG. 1). Each of the rails 90 is mounted evenly with a corresponding rail 90 on the opposite end of the support frame 20, i.e. rails 91 and 92. Each corresponding set of even rails 90 allows the platform 30 to be positioned at a set height. The first set of rails 91, 92 is positioned near the bottom of the frame 20. The second set of rails 93, 94 is positioned near the middle of the frame 20. The third set of rails 95, 96 is positioned near the top of the frame 20.

FIG. 1 shows a single worker W supported on the workhorse 10. The platform 30 is large enough, however, to support two workers on the workhorse 10 at the same time. In the instance where there is a significant difference in the height of the two workers, the position of the platform 30 may be adjusted to compensate for the height difference. The platform 30 may be positioned on an incline so that the taller of the two workers may stand on the lower portion of the platform, while the shorter worker may stand on the higher portion of the platform. For example, a first end of the platform 30 may be positioned on rail 91 while a second end of the platform 30 is positioned higher on rail 94.

A plurality of threaded fasteners 100 is disposed along the exterior surface 78 of the two front posts 70. Each threaded fastener 100 extends out of the post 70 and has a securing device 102 releasably secured to it. The threaded fasteners 100 are adapted to releasably secure a guard rail 80 to the two front posts 70. The guard rail 80 prevents the worker W from falling off of the workhorse 10 while hanging sheet rock. The guard rail 80 may be repositioned at varying heights on the posts 70 consistent with the height of the platform 30.

The wheel assemblies 50 are disposed on the bottom surface 44 of the base board 40. The wheel assemblies 50 allow the worker W to move the workhorse 10 along a workspace. Each wheel assembly 50 is positioned directly underneath one of the posts 70. The wheel assemblies 50 each comprise a wheel 52, a wheel mount 54 and a locking lever 56. The wheel mount 54 is secured to the wheel 52 at its axis and mounts the wheel 52 to the bottom surface 44 of the baseboard 40. The wheel mount 54 is preferably a caster that allows the wheels to be pivoted in different directions. The locking lever locks the wheels 52 to prevent the workhorse 10 from moving. The wheel assembly 50 further comprises a lock rod 58 (shown in FIG. 1) that allows the worker W to unlock/lock the wheels 52 while standing on the platform 30. The locking rods 58 are secured to one end of the locking levers 56 and extend upward towards the platform 30. The worker W can pull up or push down on the locking rod 58 to move the locking lever 56 from a locked to an unlocked position and from an unlocked to a locked position.

Figure 3:
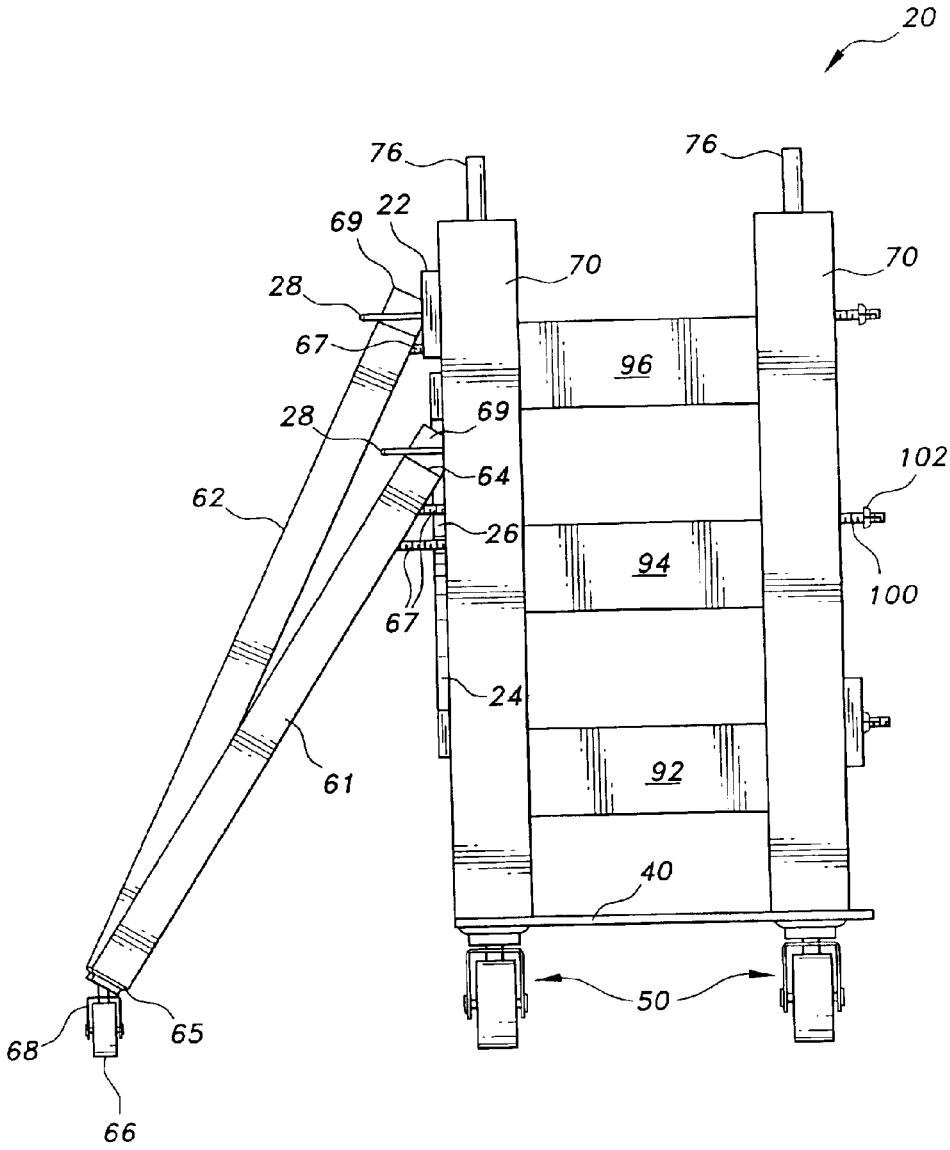
FIG. 3 is a side view of the frame of the adjustable height workhorse.

The workhorse 10 also provides a plurality of support braces 60 (FIGS. 1, 3 and 4). The braces 60 extended on a slope, outward from the rear of the workhorse 10. When the braces 60 are in place they prevent the workhorse 10 from tipping over. According to the preferred embodiments of the present invention the workhorse 10 provides three braces 60; two sides braces 61, 63 and a center brace 62.

Each of the braces 60 comprises an elongate body having a top end 64 and a bottom end 65. Each brace 60 has a brace wheel 66 mounted to its bottom end 65 by a brace wheel mount 68. The brace wheel mount 68 secures the brace wheel 66 to the brace 60 and locks the wheel 66 to prevent it from rolling. The wheel mount 68 locks the brace wheels 66 in place so that they only roll side to side and not front to back. Each of the braces 60 has a mounting projection 69 that extends from the top end 64 of the brace 60. Each mounting projection 69 is adapted to releasably engage one of a plurality of mounting hooks 28 secured to the workhorse 10. A plurality of threaded brace fasteners 67 more firmly secures the braces to the workhorse 10. As shown in FIG. 4, the side braces 61, 63 are secured to the two rear posts 70. The center brace 62 is secured to the top cross bar 22 of the workhorse 10.

Figure 5:
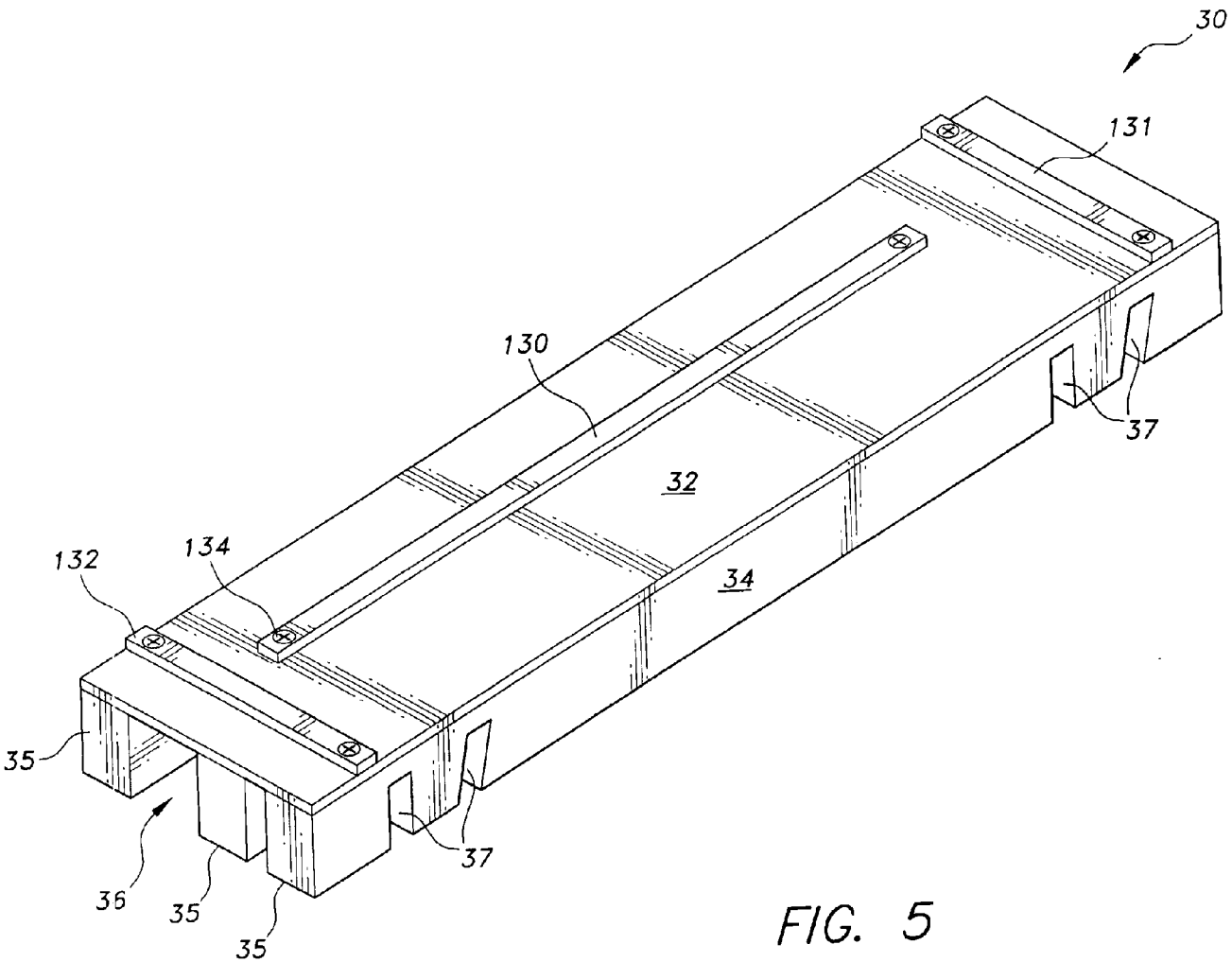
FIG. 5 is a top perspective view of the platform of the adjustable height workhorse.

FIG. 5 is a top perspective view of the platform 30. The platform 30 provides a sturdy workspace that may hold the worker W and his sheet rock material M. According to the preferred embodiments, the platform 30 comprises a generally rectangular, flat top board 32 and a plurality of rails 35 disposed along the bottom surface of the top board 32. The preferred embodiment of the platform 30 comprises three rails 35 that define two openings 36 that extend along the entire length of the platform 30.

Figure 6:
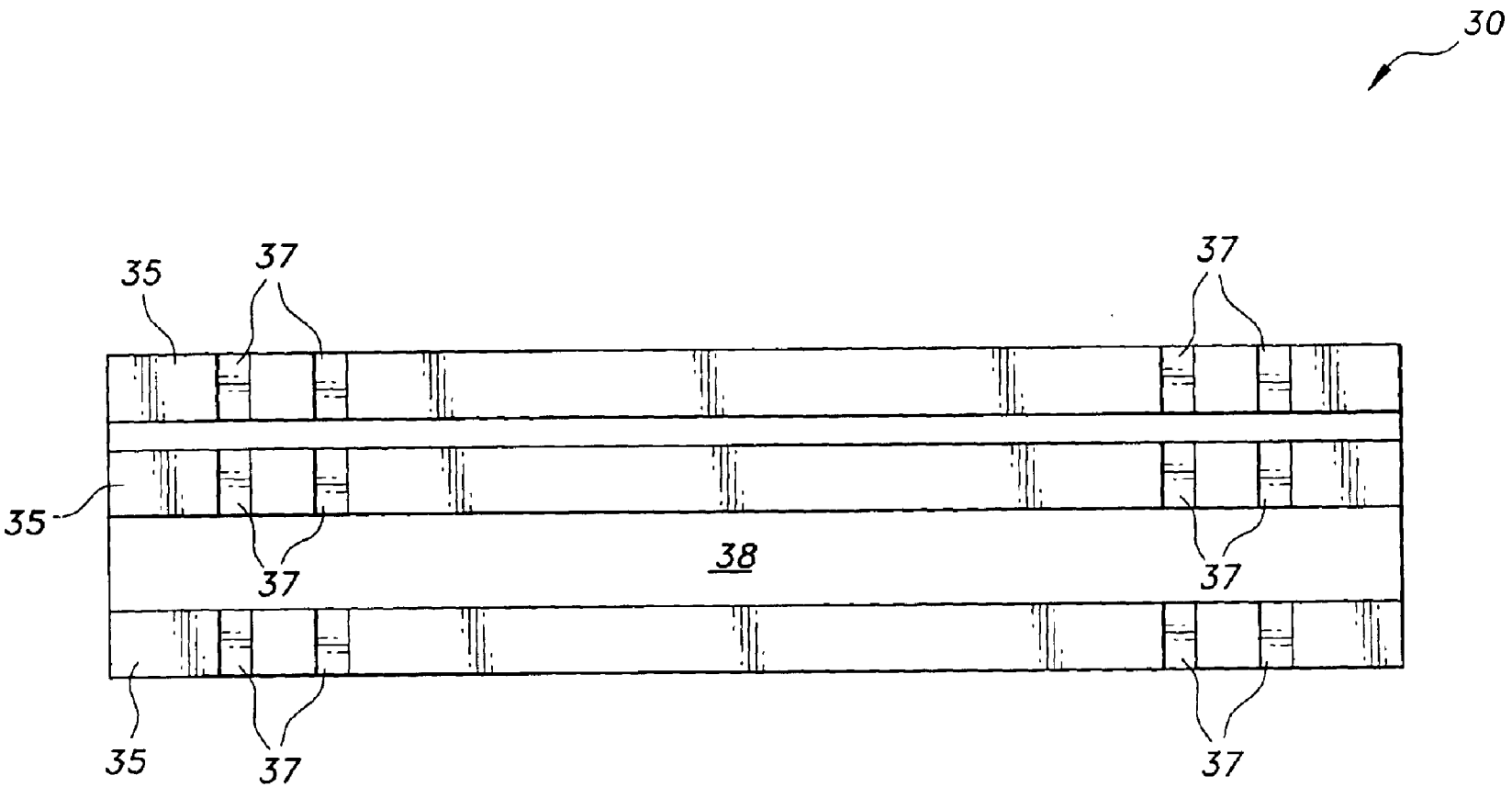
FIG. 6 is a bottom view of the platform of the adjustable height workhorse.
Figure 7:
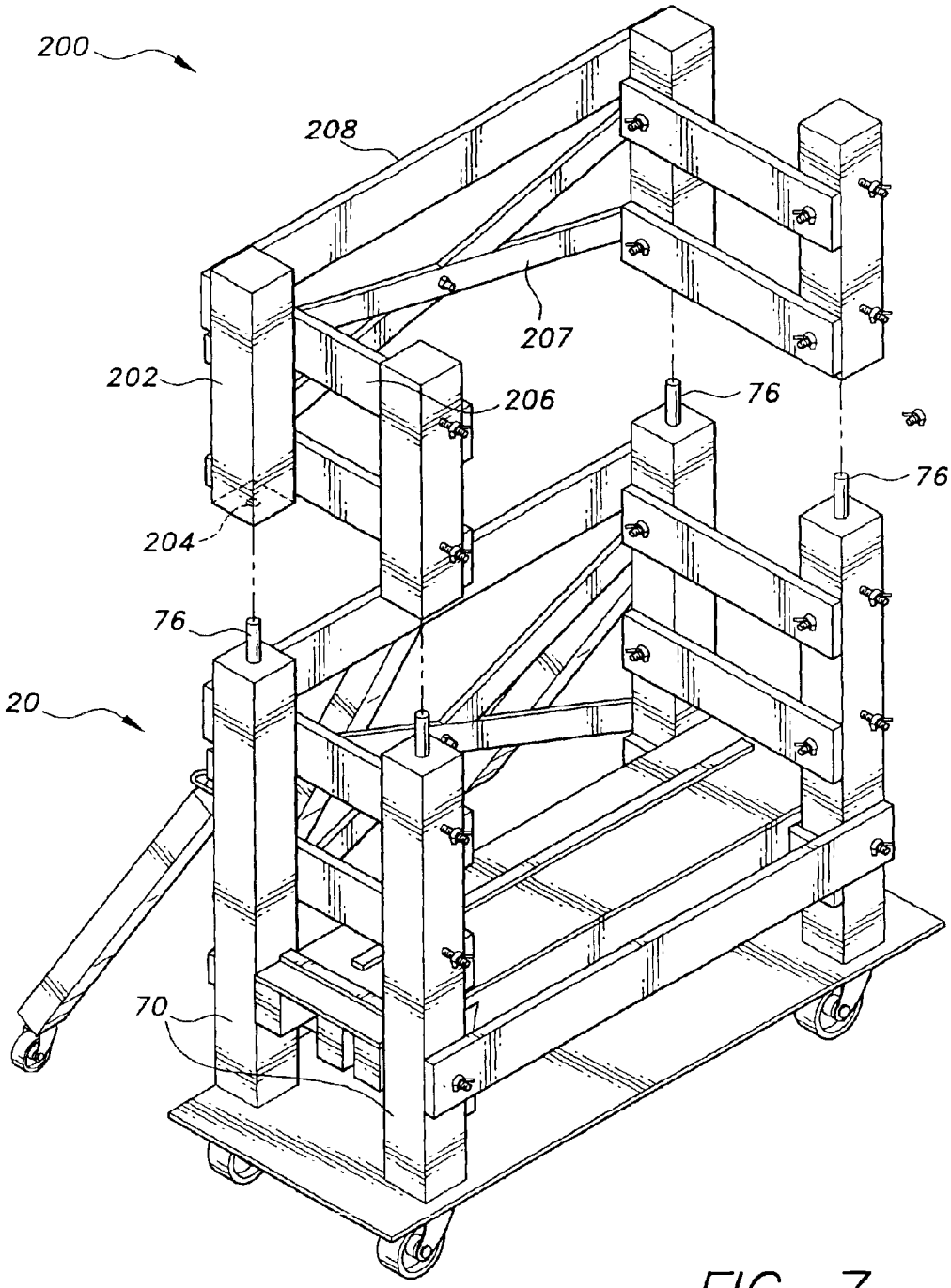
FIG. 7 is an exploded perspective view of a second embodiment of the present invention.

The platform 30 further comprises a plurality of mounting slots 37 (also shown in FIG. 6) that define generally rectangular openings that extend through the rails 35 from the front surface 34 of the platform across the entire width of the platform 30. The mounting slots 37 are adapted for releasably engaging the height adjustment bars 90 that support the platform 30. According to the preferred embodiment of the present invention the platform has a set of mounting slots 37 disposed on either side of the platform 30. Each set comprises two slots 37. The multiple slots 37 in each set allow the position of the platform 30 on the frame 20 to be adjusted.

A plurality of restraint beams is disposed along the top surface of the top board 32. According to the preferred embodiments there are two side restraints 131, 132 and a center restraint 130. The restraints are generally rectangular, elongate beams that are disposed along the surface of the platform 30. The restraints are secured to the platform 30 by a plurality of restraint fasteners 134, which are preferably threaded fasteners such as screws. The restraints prevent the sheetrock material M from sliding off of the platform 30 while the worker W is working. The center restraint 130 holds the material M in place on the platform 30 by securing the material M against the rear of the support frame 20. The side restraints 131, 132 allow the worker W to store waste material along the sides of the support frame 20 while the worker W remains on the platform 30.

If the worker W needs to further increase the height of the platform 30 then an additional support frame 200 may be secured to the top of the support frame 20. The second support frame 200 comprises a plurality of posts 202, a plurality of height adjusting bars 206 and a plurality of cross bars 207, 208. The individual elements of the second support frame 200 are generally equivalent to the elements of the support frame 20. The second support frame 200 further comprises a frame connector hole 204 disposed on the bottom surface of each of its posts 202. The connector hole 204 is adapted to engage the post securing pins 76 of the support frame 20 to releasably engage the second support frame 200 to the support frame 20. An additional set of braces 60 may also be used to aid in supporting the second frame 200.

Figure 8:
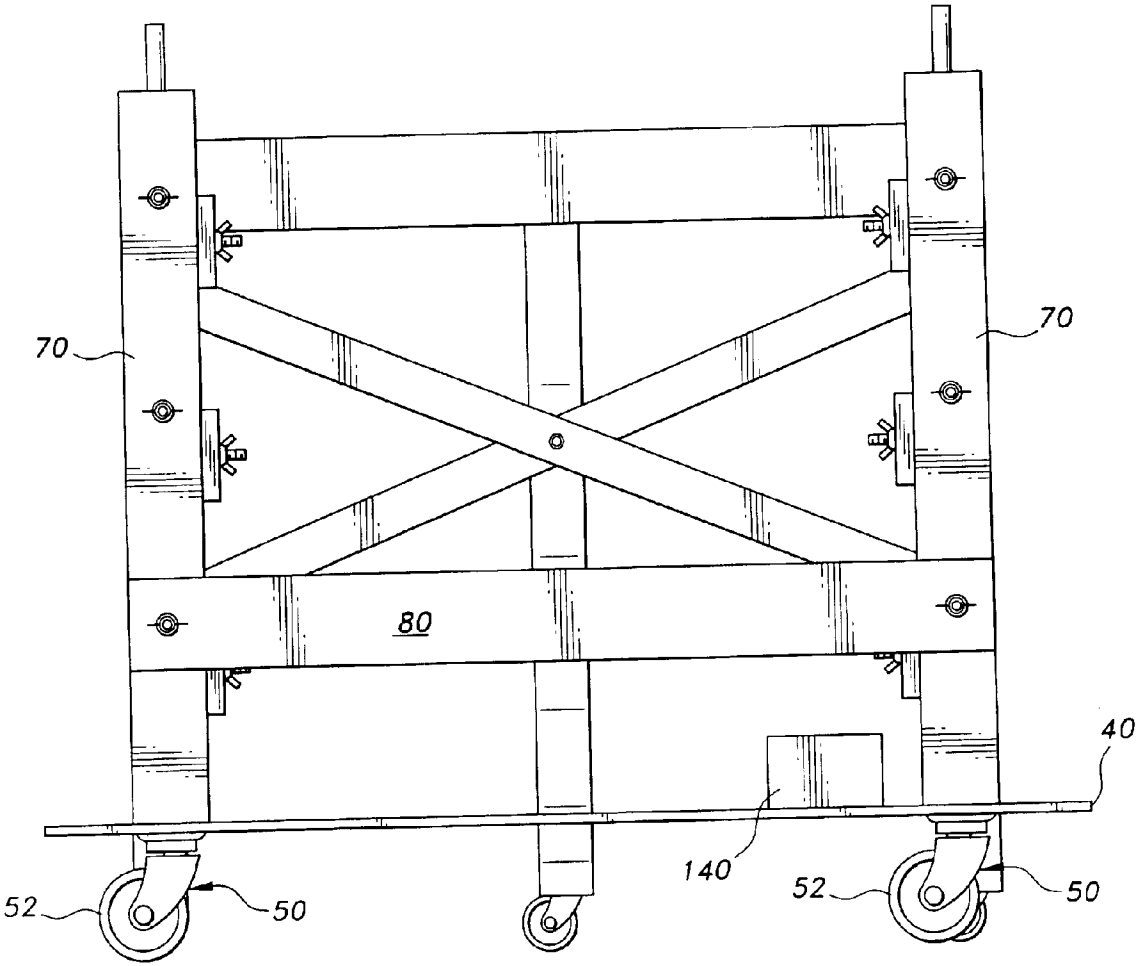
FIG. 8 is front view of a third embodiment of the present invention.

The workhorse 10 may be easily moved by the worker W while he is either on or off of the workhorse 10. The workhorse W is easily moved by releasing the wheel lock and then manually pushing the workhorse 10. The wheels 52 may roll forward, backward and side to side to reposition the workhorse 10 in any direction. FIG. 8 depicts a front view of a second embodiment of the present invention. The embodiment depicted in FIG. 8 provides a motor 140 for automatically repositioning the workhorse 10. The motor 140 is disposed on the top surface 42 of the base board 40. The motor 140 provides power to the wheels 52 to move the workhorse 10. The worker W may optionally be supplied with a remote control for the motor 140 to activate and control the motor 140 while positioned on the elevated platform 30.

The support frame 20, including the posts 70, the cross bars 22, 24, 26, the height adjusting bars 90 and the guard rail 80 are all made from a light metal pipe similar to the material used in conventional scaffolds. Preferred embodiments of the present invention will be made from materials including, but not limited to, light steal and aluminum. The baseboard 40 and the top board 32 of the platform 30 are preferably made from plywood. The rails 35 underneath the platform 30 are preferably made from aluminium as well, but any suitable strong, light material may also be used.

It is to be understood that the present invention is not limited to the embodiments described above, but encompasses any and all embodiments within the scope of the following claims.

I claim:

1. An adjustable height workhorse, comprising:

a generally rectangular, flat base board having a top surface, a bottom surface, and two ends;

a support frame disposed on the top surface of said base board having a plurality of vertically disposed posts, a plurality of height adjustment bars horizontally disposed across said posts on either side of said frame, a plurality of cross boards disposed across the back of said frame and a guard rail horizontally disposed across the front of said frame;

a plurality of wheel assemblies disposed on the bottom surface of said base board each having a wheel, a wheel mount, and a wheel lock;

a plurality of braces including a pair of outer braces and a central brace extending outwardly from the back of said frame;

each one of said plurality of braces including an elongate body having a top end, a bottom end, a brace wheel mounted to mounted to the bottom end by a brace wheel mount, and a mounting projection disposed on the top end releasably mounting the braces adjacent to the top of the support frame; and a platform, horizontally disposed across said frame and being supported by the plurality of height adjustment bars, said platform including a generally rectangular, flat top board and a plurality of rails disposed along the length of the bottom surface of the top board.

2. The adjustable height workhorse according to claim 1, wherein said support frame comprises two vertically disposed posts on each end of said base board.

3. The adjustable height workhorse according to claim 1, wherein each of said posts comprises a top end, a bottom end, a front, a back, and a post securing pin disposed on the top end.

4. The adjustable height workhorse according to claim 2, wherein said support frame comprises two sets of height adjustment bars, each set having three height adjustment bars and each set being disposed across the two vertically disposed posts on each end of said base board.

5. The adjustable height workhorse according to claim 1, further comprising a plurality of threaded fasteners disposed along the front side of the front post on each end of the base board, said fasteners being adapted to releasably receive a securing device.

6. The adjustable height workhorse according to claim 5, wherein said guard rail is releasably secured to said support frame by the plurality of threaded fasteners and corresponding securing devices.

7. The adjustable height workhorse according to claim 1, wherein said plurality of braces comprises three braces.

8. The adjustable height workhorse according to claim 1, further comprising a plurality of mounting hooks disposed on said support frame for receiving the mounting projections on said braces.

9. The adjustable height workhorse according to claim 1, further comprising a plurality of threaded brace fasteners for firmly securing the braces to the support frame.

10. The adjustable height workhorse according to claim 1, wherein said plurality of rails comprises three rails.

11. The adjustable height workhorse according to claim 1, further comprising a plurality of platform mounting slots that define generally rectangular openings that extend through the rails across the entire width of the platform, said mounting slots being adapted for releasably engaging the height adjustment bars that support said platform.

12. The adjustable height workhorse according to claim 1, further comprising a plurality of restraint beams disposed on a top surface of said platform for preventing work material from sliding off of the platform.

13. The adjustable height workhorse according to claim 3, further comprising a second support frame, secured to the top of said support frame, having a plurality of vertically disposed second frame posts, a plurality of height adjustment bars horizontally disposed across the second frame posts on either side of the second support frame, and a plurality of cross boards disposed across the back of the second support frame, each of said second frame posts having a connector hole disposed on its bottom surface for engaging the pins securing posts disposed on the posts of the support frame.

14. The adjustable height workhorse according to claim 1, further comprising a motor for powering the wheel assemblies.

15. The adjustable height workhorse according to claim 1, wherein said support frame is made from a lightweight material selected from the group consisting of lightweight steel and aluminum.

16. The adjustable height workhorse according to claim 1, further comprising a wheel lock rod secured to said wheel lock and extending upward to the platform to allow the user of the workhorse to lock and unlock the wheels while standing on the platform.

* * * * *